United States Patent [19]

Tibbals, Jr.

[11] 4,156,954

[45] Jun. 5, 1979

[54] DISINTEGRATING APPARATUS

[76] Inventor: Edward C. Tibbals, Jr., 1906 Pembroke Rd., Greensboro, N.C. 27408

[21] Appl. No.: 878,973

[22] Filed: Feb. 17, 1978

[51] Int. Cl.[2] ..... D01G 7/06

[52] U.S. Cl. ..... 19/81; 19/82

[58] Field of Search ..... 19/80 R, 81, 82, 83, 19/145.5; 241/101 A, 101.7; 225/97, 100, 101, 103, 106

[56] References Cited

U.S. PATENT DOCUMENTS

| | | | |
|---|---|---|---|
| 3,736,624 | 6/1973 | Alt et al. | 19/80 R |
| 3,900,920 | 8/1975 | Whitehurst | 19/81 |

FOREIGN PATENT DOCUMENTS

| | | | |
|---|---|---|---|
| 16894 | 6/1914 | United Kingdom | 19/81 |

*Primary Examiner*—Dorsey Newton

*Attorney, Agent, or Firm*—Joseph H. Heard

[57] ABSTRACT

The apparatus is particularly adapted for disintegrating bale-like masses of waste textile strand material that includes synthetic (e.g., polyester, nylon, etc.) textile strands of large-magnitude tensile strength and frequently of considerable length. The length and strength of such strands, in conjunction with their normally quite-random and entangled array within the bale-like masses received by a reclaimer of waste strand material, has heretofore necessitated the manual disintegration of such masses. The apparatus of the present invention automatically and efficiently disintegrates bale-like masses of waste textile strand material of the above-described type, as well as of other types, and does so in a manner which does not so impair desirable physical properties of the strand material as to restrict its various end-uses.

21 Claims, 10 Drawing Figures

DISINTEGRATING APPARATUS

BACKGROUND OF THE INVENTION

This invention relates to disintegrating apparatuses, and more particularly relates to an apparatus which is especially (but not exclusively) adapted for the disintegration of bale-like masses of waste textile strand material that includes polyester, nylon and/or other synthetic textile strands which have tensile strength of large magnitude and which frequently also are of considerable length.

As employed herein, the appellation "textile strand material" is meant to encompass all manner of natural or synthetic fibers, filaments, slivers, rovings and yarns, as well as all combinations of any of the foregoing, such as "composite" or "core" yarns incorporating both filamentary strands and spun-staple fibers, tow, smaller "bundles" of texturized or untexturized filaments, etc.

Prior patents of possible relevance to the present invention, or to its background, include the following: U.S. Pat. Nos. 3,941,530, 3,900,920, 3,886,629, 3,797,073, 3,736,624, 3,676,991, 3,663,993, 3,653,094, 3,443,285, 3,099,047, 3,040,387, 2,241,151, 2,205,666, 1,340,201, 188,928 and 20,677; French Pat. No. 814,365 and German Pat. No. 325,207.

Numerous so-called "bale pluckers" or other apparatuses have heretofore been devised for the purpose of disintegrating bales, cheeses or similar masses of natural textile fibers, such as cotton or wool, or of synthetic textile fibers comprised of "staplized" synthetic filaments. Fibers of the aforesaid type are relatively short, their maximum length usually being no more than four to five inches and frequently much less, and the tensile strength, both of the individual fibers and of the nonintegrated groupings or "tufts" of adjacent ones of them, is relatively small. Additionally, the bales comprised of such fibers usually possess approximately equal characteristics of density, composition and the like throughout either their entire extent or, if such bales are of "layered" construction, throughout at least each of their individual layers. Bales of the foregoing composition and construction may be and are readily disintegrated by known "bale plucking" apparatuses, many of which employ at least one rapidly-rotating "plucker roll" having peripheral teeth or pins which engage a surface of the bale and readily withdrawn discrete "tufts" of fiber therefrom.

Quite different considerations are presented by bales or similar masses of waste textile strand material of the type inadvertently but regularly produced, as a waste by-product of their normal operations, by manufacturers of synthetic filaments and by throwsters, textile mills and similar organizations which process and/or use such filaments in the manufacture of yarns or other products. Waste material of the aforesaid type may include at least some amount of relatively short strands, consisting of "staplized" filament or of natural fibers or of a combination of the foregoing, either in discrete form or in the form of roving, sliver or the like of low tensile strength. However, a significant portion and usually the vast majority of the waste strand material will consist of such things as single or multiple-ply yarn spun in whole or in part from "staplized" synthetic filaments; filamentary, and/or "core" yarns formed in whole or in part from continuous filaments; and other continuous-filament "bundles", such as tow, whose dimensions may approach those possessed by ropes and cables. Such strand material has a tensile strength of large magnitude: Some of it will withstand an applied tensile force of thousands of pounds, and may also undergo great elongation, before breaking. Apart from the possibility of its further elongation by stretching, at least some of the waste strand material also will usually be of considerable length in its unstretched form: i.e., its length will be many feet, or even hundreds of yards, as opposed to the much smaller length of natural fibers and of "staplized" filaments. Additionally, when waste strand material is set aside for eventual reclamation, it normally is not arranged in any type of orderly fashion, but rather is merely tossed or otherwise casually deposited into a container or upon a pile until a mass of the desired quantity has been accumulated. Such mass may then be formed into a bale to facilitate its transport to a reclaimer of waste material, or may be delivered to a reclaimer in unbaled form. In either case the mass of strand material received by the waste-reclaimer will be of heterogeneous density and composition, and will include randomly-extending and intertangled textile strands of large-magnitude tensile strength and, in many cases, of considerable length.

Masses of strand material of the aforesaid type cannot be satisfactorily disintegrated by conventional "bale pluckers", including particularly those employing a rotatable "plucking roll" or similar instrumentality, such as an endless toothed apron driven in one direction along a closed loop-like path of travel, as the disintegrating instrumentality. Attempted use of conventional "bale pluckers" and similar apparatuses for the aforesaid purpose results not in disintegration of the mass of strand material, but rather in disintegration of the apparatuses themselves unless the latter are equipped with suitable stop-motion devices effective to halt their operation in response to the over-load stresses which are placed upon their components by strand material of the described type. In recognition of the foregoing fact, the now prevalant industry practice is for strand-masses of the type in question to be manually disintegrated or "picked-apart", by a person withdrawing successive hand-fulls and lengths of strand material from the mass and depositing the same in a strand-cutting device or other processing instrumentality, or upon a conveyor leading to such a device or other instrumentality. This approach is highly dangerous, inefficient and uneconomical, and significantly increases the cost of reclamation of the waste material. An alternative industry-approach problem has been to employ disintegrating apparatuses, for instance hammer-mills, which do not preserve the quality and character of the strand material and which so pulverize, heat and/or otherwise deteriorate the same as to render it suitable only for re-melting and re-extrusion, or for other limited and commercially less-valuable uses. This approach is also highly uneconomical since it results in complete loss of that portion of the value of the strand material attributable to the prior processing (e.g., extruding, drawing, texturizing, etc.) which it has undergone. Additionally, unless the supply hopper or the like of the hammer mill or other apparatus in question is of considerable size, some manual "picking-apart" of the mass of strand material is still necessary for introduction of the material into the apparatus.

SUMMARY OF THE INVENTION

The present invention provides a highly reliable and durable apparatus which is particularly adapted for and capable of automatically and efficiently disintegrating bale-like masses of textile strand material, of the previously-described type including synthetic textile strands of large-magnitude tensile strength and frequently also of considerable length, while at the same time so preserving the material's quality and properties as to permit any desired type of further reclamation-processing and end-use thereof. By way of example in the latter regard, strand material withdrawn from a bale-like mass of the type in question by the present apparatus is in suitable condition for direct delivery by the apparatus to a suitable rotary cutting device, wherein the strands are formed into shorter segments of desired lengths and may also be "opened" to a considerable extent, to produce fluffy fibrous output admirably suited (usually after further processing, such as garnetting) for use as padding and/or insulating material in mattresses, pillows, cushions and the like, or for use as raw material in a yarn-spinning operation.

The apparatus of the present invention is of massive high-strength construction and has an elongate passageway extending throughout its entire length. Communicating with respective rearward and forward end portions of such passageway are a receiving station which is adapted to receive a bale or other mass of the strand material to be disintegrated, and outlet means which is adapted to receive strand material withdrawn from such mass. Strand entraining means, which includes a carriage-like component mounting a large number of extendable and retractable tooth-like components, is reciprocatorily movable forwardly and rearwardly along a linear path of travel closely adjacent and generally parallel to the aforesaid passageway throughout substantially its entire length. During at least part of each stroke of forward movement of the carriage component of the entraining means, its tooth-like components are extended into the passageway so as to then withdraw strand material from the mass thereof at the receiving station and transport the withdrawn strand material forwardly through the passageway. The quantity of strand material so withdrawn by the entraining means during each of its forward-movement strokes may be and preferably is controlled, to minimize possible overloading or "choking" of the apparatus, by maintaining a predetermined compressive force upon the bale or mass of strand material within the receiving station, and by varying the point in time during each forward-movement stroke of the entraining means at which its tooth-like components are extended into the passageway and thus into engagement with the bale of strand material. The strand material withdrawn from the bale or mass by the entraining means is advanced by it, during the same or a subsequent one of its forward-movement strokes, forwardly through the passageway to, and preferably beyond in the case of at least some of the strand material, the passageway's outlet means. During each stroke of rearward movement of the entraining means its hook-like components are retracted so as to reduce the possibility of any previously withdrawn strand material not fully introduced into the outlet means, and thus remaining in the passageway, being returned to the receiving station under the impetus of rearward movement of the entraining means. To further guard against if not altogether obviate the foregoing undesirable result, extendable and retractable strand restraining means are projected, during each rearward movement stroke of the entraining means, from a retracted position outside of the passageway to an extended position within that portion of the passageway intermediate the receiving station and the outlet means.

During the terminal portion of each rearward stroke of movement of the strand entraining means, withdrawn strand material previously deposited by the entraining means within that portion of the passageway projecting forwardly of the outlet means, as previously described, is moved rearwardly through such projecting passageway portion back to the outlet means. This is preferably accomplished by a blade or rake-like pusher member disposed within the projecting passageway portion and movable longitudinally thereof under the impetus of a lost-motion innerconnection with the entraining means. In addition to other benefits, the above described mechanism helps insure the presence of a desired quantity of withdrawn strand material within, or at least in the immediate vicinity of, the outlet means at substantially all times during operation of the apparatus. This in turn permits the output of the apparatus, and therefore the output of the device or mechanism which receives the strand material from the apparatus's outlet means, to be of a substantially continuous nature, rather than intermittent.

Some of the strand material transported to out outlet means, by the entraining means and/or the pusher member, will freely enter the outlet on its own initiative. But some long segments, large "clumps" and/or other portions of the strand material will frequently not do so, and will instead tend to "bridge" the outlet. To overcome this problem, and also to further contribute to realization of the previously-discussed uniformity of output, the apparatus additionally includes extendable and retractable stuffer means which extends into the passageway and assists in introducing into the outlet "bridging" or other strand material then immediately adjacent thereto.

The apparatus further includes control means which reliably causes the above-described and other components of the apparatus to automatically perform their respective functions at desired times and in proper sequence. The control means is also effective to temporarily halt operation of certain components of the apparatus upon the occurrence and during the pendency of an undesirable operating condition within either the apparatus itself or within the device which receives strand material from the apparatus's outlet.

DESCRIPTION OF THE DRAWINGS

Other features and benefits of the invention will be apparent from the following description of an illustrative embodiment thereof, which should be read in conjunction with the accompanying drawings, in which.

DESCRIPTION OF THE PREFERRED EMBODIMENT

Figure 1:
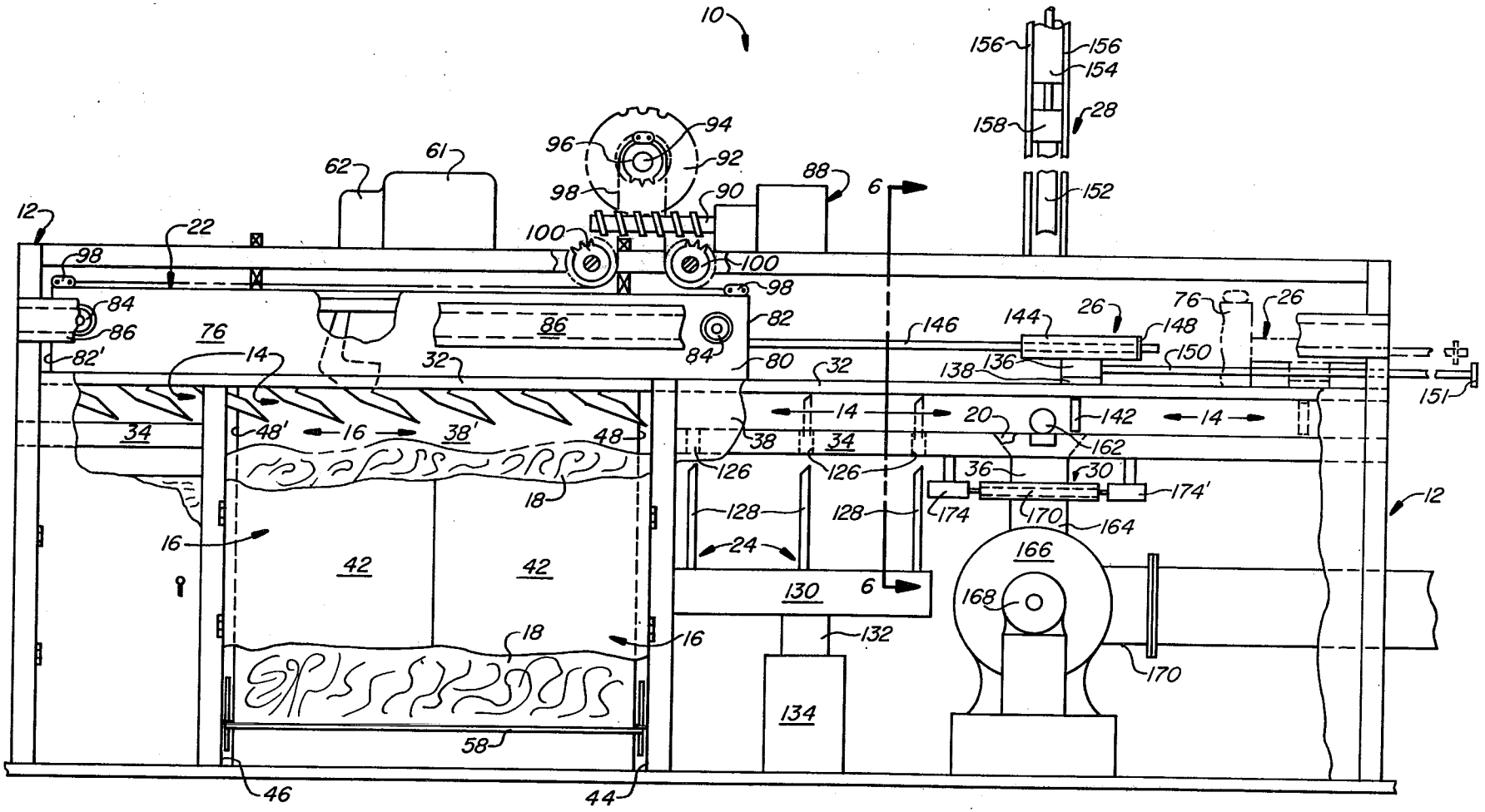
FIG. 1 is a partially-schematic side elevational view of a disintegrating apparatus in accordance with the present invention, some components of the apparatus being broken away to better disclose interior details.

The disintegrating apparatus identified in its entirety in FIG. 1 by the numeral 10 includes frame means 12 having an elongate passageway 14 extending generally horizontally throughout its entire length and substantially its entire width. Underlying and communicating freely with a rearward (leftward, as viewed in FIG. 1) end portion of passageway 14 is a station or compartment 16 which receives a bale or other mass of strand material to be disintegrated. An outlet 20, which is adapted to receive strand material withdrawn from mass 18 and conducted to the outlet through passageway 14, is provided in communication with a forward (rightward, as viewed in FIG. 1) end portion of passageway 14. Strand entraining means 22 is reciprocatorily movable forwardly and rearwardly along a linear path of travel extending in closely adjacent and parallel relationship to passageway 14 throughout substantially its entire length. During its strokes of forward (rightward, as viewed in FIG. 1) movement, entraining means 22 is adapted to withdraw strand material from mass 18 and to transport withdrawn strand material forwardly through passageway 14 to locations therewithin adjacent outlet 20. Entraining means 22 and the subsequently-described drive mechanisms associated therewith are so constructed as to impose forces in excess of 200,000 pounds magnitude upon the strand material if, as is sometimes the case, forces of such magnitude should be required to effect the aforesaid withdrawal and/or transportation of the strand material. During each stroke of rearward (leftward, as viewed in FIG. 1) movement of entraining means 22, strand restraining means 24 projects into that portion of passageway 14 intermediate compartment 16 and outlet 20 to assist in preventing previously-withdrawn strand material within such passageway portion from being then carried rearwardly back to compartment 16 under the impetus of return movement of entraining means 22. Pusher means 26 is provided within with that portion of passageway 14 projecting forwardly of outlet 20 for the purpose of rearwardly returning withdrawn strand material, previously deposited by strand entraining means 22 in such forwardly-projecting portion of passageway 14, to a location adjacent outlet 20. To further assist and/or control the discharge through outlet 20 of withdrawn strand material conducted by strand entraining means 22 and/or pusher means 26 to a location within passageway 14 adjacent outlet 20, apparatus 10 further includes stuffer means 28 and gate means 30 associated with such outlet. Still other components of apparatus 10 will be pointed out during the following more-detailed description of those components generally identified above.

Referring now to other figures of the drawings in addition to FIG. 1, the upper extremity or top of passageway 14 is defined by a plurality of laterally-spaced grid bars 32 (FIGS. 1, 4–6, and 8) extending horizontally in parallel relationship to each other throughout substantially the entire length of apparatus 10. The section of passageway 14 overlying compartment 16 of apparatus 10 is bottomless, thereby permitting the projection into such passageway section of the upper portion of the mass 18 of strand material within compartment 16. Elsewhere along its length the lower extremity or bottom of passageway 14 is defined by rigid plate means 34 (FIGS. 1, 6 and 9) which extends in vertically-spaced underlying and parallel relationship to grid bars 32. Outlet 20 of apparatus 10 comprises, as shown in FIGS. 1, 6 and 9, an opening provided through and across substantially the entire width of passageway bottom plate 34, and communicating with duct means 36 (FIGS. 1, 6 and 7) extending downwardly from such plate. Along most of its length the opposite lateral extremities of passageway 14 may be and illustratively are overlaid by sections of vertical frame panels 38,38′ respectively disposed at opposite sides of apparatus 10. Openings 40,40′ (FIG. 6) are provided through the respective passageway panel sections 38,38′ immediately adjacent outlet 20, for a purpose to be subsequently described.

Figure 3:
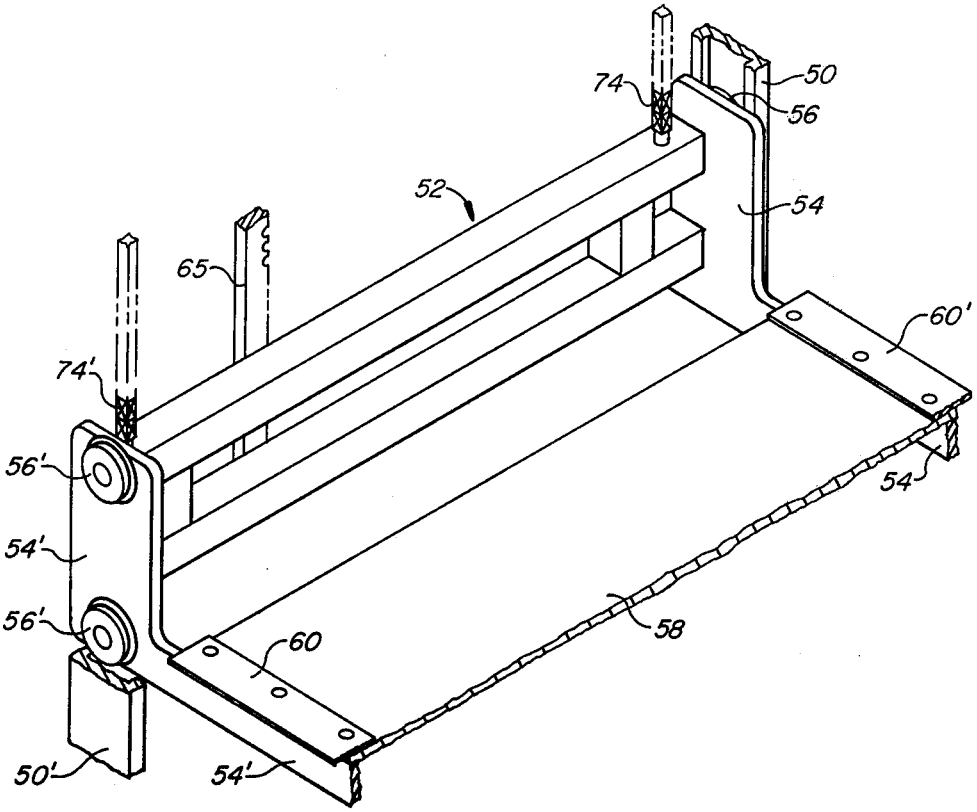
FIG. 3 is an enlarged fragmentary perspective view of a vertically movable platform, and some adjacent components, associated with the bale receiving station of the apparatus.
Figure 2:
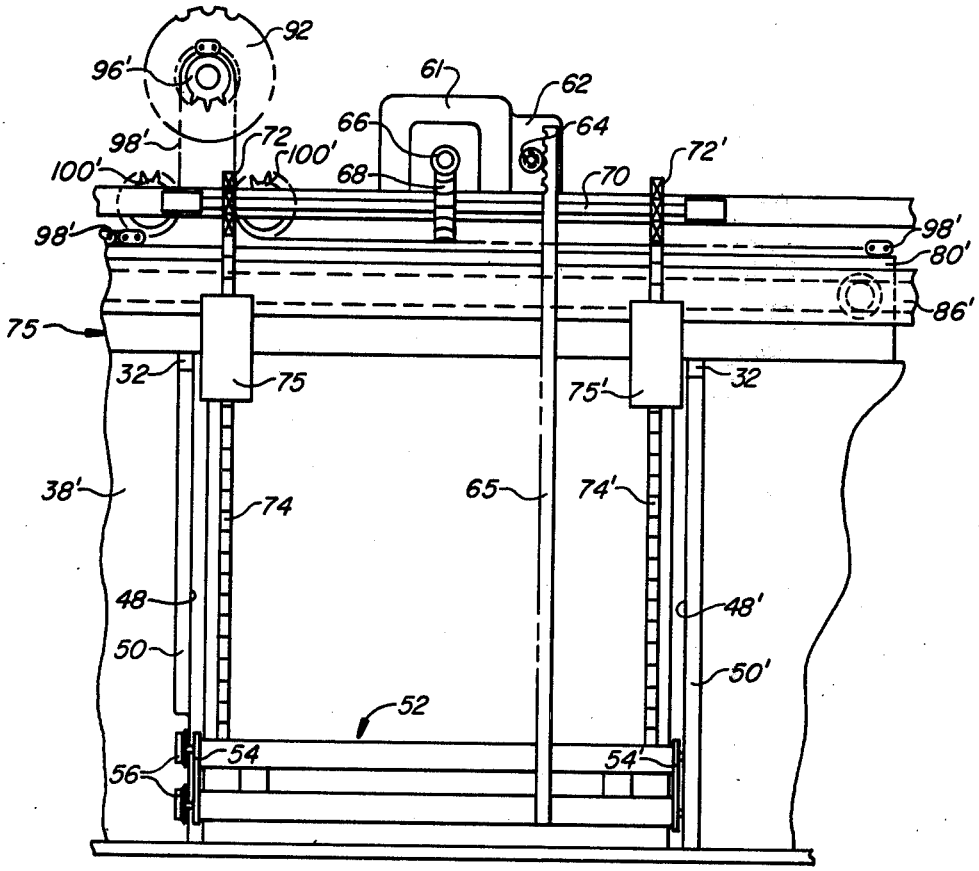
FIG. 2 is a partially-schematic elevational view of a portion of the opposite side of the apparatus shown in FIG. 1.

Access to bale compartment 16 is provided on the FIG. 1 side of apparatus 10 by pivotally-mounted door members 42. The opposite wall of compartment 16 is defined by one of the frame panels 38′ (FIGS. 1 and 2) upon the other side of apparatus 10. Compartment 16 also has respective forward and rearward walls 44,46 (FIG. 1) which span the width of apparatus 10 and which extend vertically from the base of the apparatus to the undersurface of bottom plate 34 of passageway 14. As is best shown in FIG. 2, the wall of compartment 16 defined by one of side panels 38′ has a pair of longitudinally-spaced slots 48,48′ extending therethrough. A pair of elongate track members 50,50′, each of which has a generally U-shaped cross-section configuration indicated in FIG. 3, overlie the exterior surface of panel 38′ and extend in adjacent parallel relationship to slots 48,48′, respectively. A frame assembly 52 (FIGS. 2 and 3) extends between and is mounted for vertical movement by track members 50,50′. Assembly 52 includes generally L-shaped end plates 54,54′ upon the respective vertical legs of which are mounted rollers 56,56′ which are received within respective ones of the track members 50,50′. The generally horizontally extending legs of plates 54,54′ project through slots 48,48′ into the interior of bale compartment 16. Mounted upon the legs of plates 54,54′ within compartment 16 is a platform 58 having width and length dimensions only slightly less than the corresponding interior dimensions of compartment 16. Platform 58 supports the mass 18 of strand material within compartment 16. To assist in keeping the space beneath compartment 16 free from strand material, strips of resilient material 60,60′ are preferably and illustratively secured to the forward and rearward edges of platform 58 so as to project therefrom into engagement with the adjacent compartment walls 44,46 (FIG. 1).

Vertical movement is imparted at desired times to frame assembly 52, and thus to the platform 58 and the strand mass 18 within compartment 16, by drive means best shown in FIG. 2 and including a reversible motor-transmission-brake unit 61, which is mounted along with an associated control unit 62 atop frame 12 of apparatus 10. Unit 61 is effective to at desired times impart selective rotation in either direction to a worm member 66 extending therefrom, and to at all other times apply a braking force prohibiting the worm's rotation. Worm 66 meshes with a worm gear 68 secured to a shaft 70 mounted by suitable bearings in spaced parallel relationship to the side of apparatus 10 shown in FIG. 2. Sprockets 72,72' affixed to opposite end portions of shaft 70 have chain members 74,74' respectively entrained about and depending downwardly therefrom. One end of each chain 74,74' is secured to frame assembly 52. Weight members 75,75' are respectively secured to the other ends of chains 74,74', so as to at least partially counterbalance the weight of assembly 52 and the platform 58 (FIGS. 1 and 3) carried by it. By reason of the foregoing innerconnection, assembly 52 and platform 58 move upwardly when unit 61 rotates worm 66 in a first direction (e.g., clockwise) and move downwardly when worm 66 is rotated in the opposite direction (e.g., counterclockwise). The range of the aforesaid vertical movement of platform 58 is between a lowermost position wherein the platform is adjacent the bottom of compartment 16, and an uppermost position wherein platform 58 is closely adjacent the horizontal plane of the upper surface of bottom plate 34 of passageway 14.

Prior to commencement of the operation of machine 10, doors 42 of compartment 16 are opened and the strand-material bale or mass 18 to be disintegrated is placed upon platform 58, which at such time occupies its lowermost position of FIGS. 1 and 2. Doors 42 are then closed and platform 58 and the strand mass 18 thereon are moved upwardly by unit 61 and the previously-described components connecting the same with platform 58. Control unit 62 interrupts the aforesaid operation of unit 61, and therefore halts the upward movement of platform 58 and strand mass 18, when the upper surface of the latter has been subjected to a compressive force of predetermined desired magnitude by reason of its engagement with the undersurface of the passageway grid bars 32 overlying compartment 16. The optimum value of the aforesaid preselected force will be within the range of from 10 to 200 pounds per square foot, depending upon the character of the particular mass 18 of strand material to be disintegrated: For most types of strand material a preselected compressive force of approximately 50 pounds per square foot has been found to be preferable. During subsequently-ensuing operation of machine 10 the strand material is progressively removed in a manner to be subsequently described from the upper portion of the mass 18 within compartment 16, and unit 61 is periodically actuated to cause platform 18 to move further upwardly to bring the successive new upper surface portions of the strand mass 18 upon the platform into compressive engagement with the undersurfaces of the overlying grid bars 32. On each such occasion the driving operation of unit 61 is again halted, with ensuing cessation of the upward movement of platform 58 and the thereon-supported strand mass 18, by control unit 62 when the compressive force upon the upper surface of the strand mass reaches a desired preselected magnitude. The aforesaid action of the control unit 62 is achieved, in the illustrative embodiment of such unit, by a switch component 63 (schematically shown in FIG. 9) which automatically interrupts the "platform-up" driving action of the motor component of unit 61 when the torque-load upon such motor reaches a value corresponding to the adjustably-variable setting of switch 63. In addition to being manually adjustable (by means not shown in the drawings) prior to the commencement of a bale-disintegrating operation, the torque-load setting at which actuation of switch 63 occurs is adjusted automatically each time platform 58 moves upwardly to compensate for the diminishing weight of the strand mass 18 upon the platform. This is done by a gear 64 (FIG. 2) which forms part of unit 61 and which is driveably engaged by a rack bar 65 (FIGS. 2 and 3) carried by and movable vertically with platform frame assembly 52. The automatic adjustment by gear 64 and rack bar 65 of the setting of switch 63 is such as to make the latter's actuation dependent at all times upon the compressive force imposed by the undersurface of grid bars 32 upon the top surface of the strand mass 18, notwithstanding the progressively-diminishing weight of the strand mass. In lieu of the aforesaid arrangement, it will of course be appreciated that the desired result could be achieved by other mechanisms, as for instance by the use in control unit 61 of a pressure-responsive switch mounted in association with the grid bars 32 overlying compartment 16.

Referring now primarily to FIGS. 1,2,4 and 6, strand entraining means 22 of apparatus 10 includes a carriage member 76 having a horizontally extending base plate 78 and upstanding side walls 80,80' and end walls 82,82'. Base plate 78 closely overlies, and spans substantially the entire width of, the array of laterally-spaced grid bars 32 defining the upper extremity of passageway 14. Carriage 76 is mounted for reciprocatory forward and rearward movement longitudinally of apparatus 10 by means of wheels 84,84', which are respectively carried by opposite carriage side walls 80,80' and are received within guide tracks 86,86', each of generally U-shaped cross-sectional configuration, disposed on opposite sides of apparatus 10 and extending substantially the full length thereof. In FIG. 1 carriage 76 is shown by solid lines in its rearmost position, and its forwardmost position is fragmentarily indicated by phantom lines. Carriage 76 is moved during operation of apparatus 10 between its aforesaid positions by drive means which includes a reversible motor-transmission-brake unit 88 mounted in any suitable manner atop frame 18 of apparatus 10. Unit is effective to at desired times impart selective rotation in either direction to a worm member 90 extending therefrom, and to at all other times apply a braking force to such worm member. Worm 90 meshes with a worm gear 92 affixed to the central portion of a shaft 94 extending substantially the full width of apparatus 10 and having chain sprockets 96,96' secured to its opposite end portions. An elongate chain member 98 (FIG. 1) is entrained about sprocket 96, and about idler sprockets 100 mounted in any suitable manner upon frame 12 beneath drive sprocket 96, and has its opposite ends respectively secured to opposite end portions of side wall 80 of carriage 76. At the other side of apparatus 10 (see FIG. 2), a second chain 98' similarly is entrained about drive sprocket 96' and idler sprockets 100', and has its opposite ends secured to side wall 80' of carriage 76. When worm 90 is rotated in a "forward"

direction by drive unit 88, chains 100,100' moves carriage 76 forwardly from its rearmost position, shown in solid lines in FIG. 1, to its forwardmost position indicated by phantom lines. Upon reversal of the direction of rotation imparted to worm 90 by drive unit 88, carriage 76 moves rearwardly back to its illustrated solid-line position.

Figure 4:
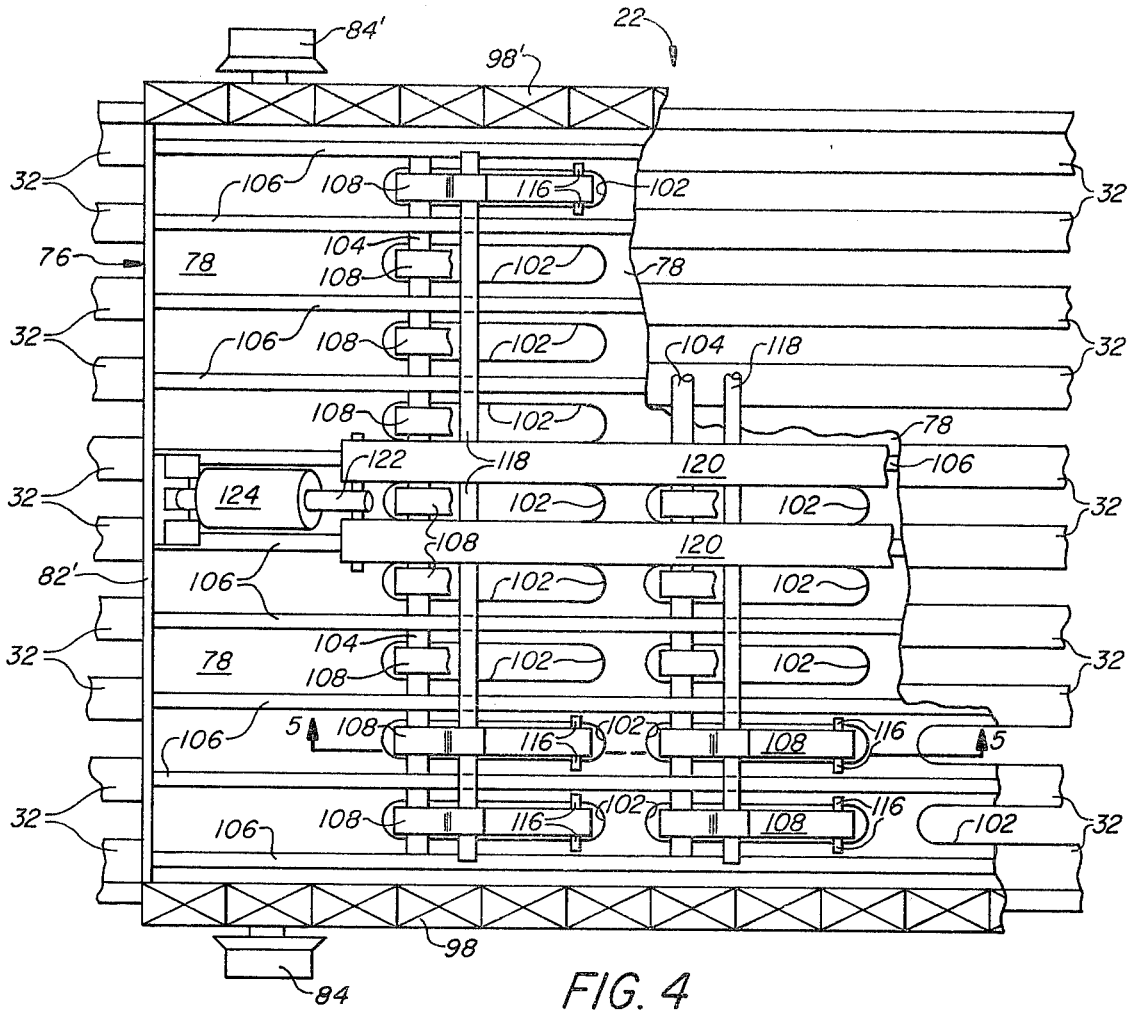
FIG. 4 is a partially-schematic, enlarged top-plan view of a portion of the strand entraining means, and some adjacent components, of the apparatus.

A plurality of elongate slots 102 (FIGS. 4 and 5) extend through base plate 78 of carriage 76. Slots 102 are arranged in a plurality of longitudinally-spaced parallel rows, there preferably being eight such rows, each of which spans substantially the full width of carriage base plate 78. One complete row and parts of two others are shown in FIG. 4. The number of slots 102 in each row, illustratively nine, corresponds to the number of spaces between adjacent ones of the parallel grid bars 32 defining the upper extremity of passageway 14. The slots 102 of each row directly overlie respective ones of such grid-bar spaces, and have widths approximately 70% of the widths of the spaces. Parallel shafts 104, mounted by bar-like bearing members 106 which are secured upon and also serve to further strengthen carriage base plate 78, overlie respective ones of the eight rows of slots 102. Nine strand entraining members 108 are fixedly secured to each shaft 104, at spaced locations along its length, and extend through respective ones of the nine slots 102 therebelow. Each entraining member 108 is of generally L-shaped configuration and includes a medial portion 110, through a rearward part of which shaft 104 projects, which innerconnects an upper shank-like portion 112 and a lower tooth-like portion 114. A stud-like abutment or stop member 116 projects laterally through and outwardly from opposite sides of medial portion 110 of each entraining member 108 at a location adjacent the junction of the forward and upper edges of portion 110. Portion 112 projects upwardly from medial portion 110 and shaft 104, while tooth-like portion 114 extends forward from medial portion 110 and underlies base plate 78 of carriage 76.

Figure 5:
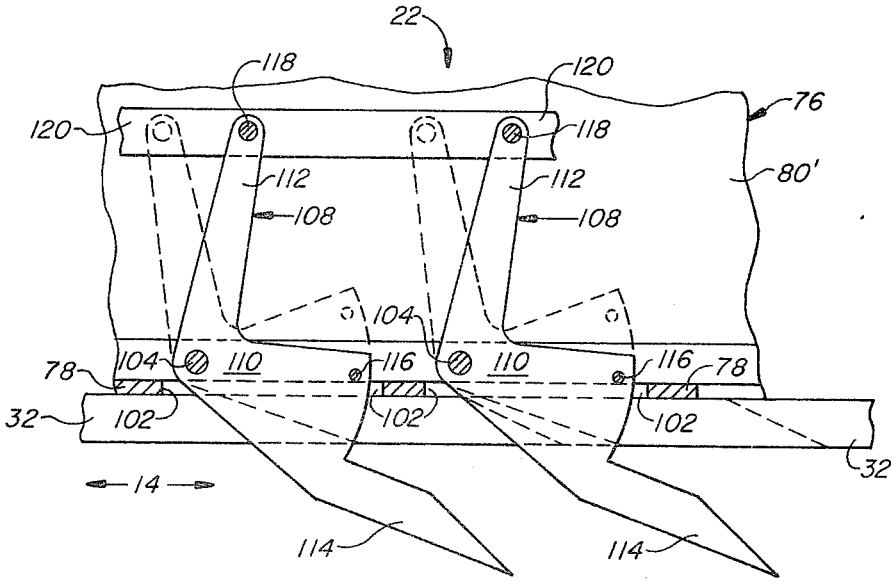
FIG. 5 is a fragmentary view taken approximately along the line 5—5 of FIG. 4, showing some components of the entraining means in side elevation and others in vertical section.
Figure 6:
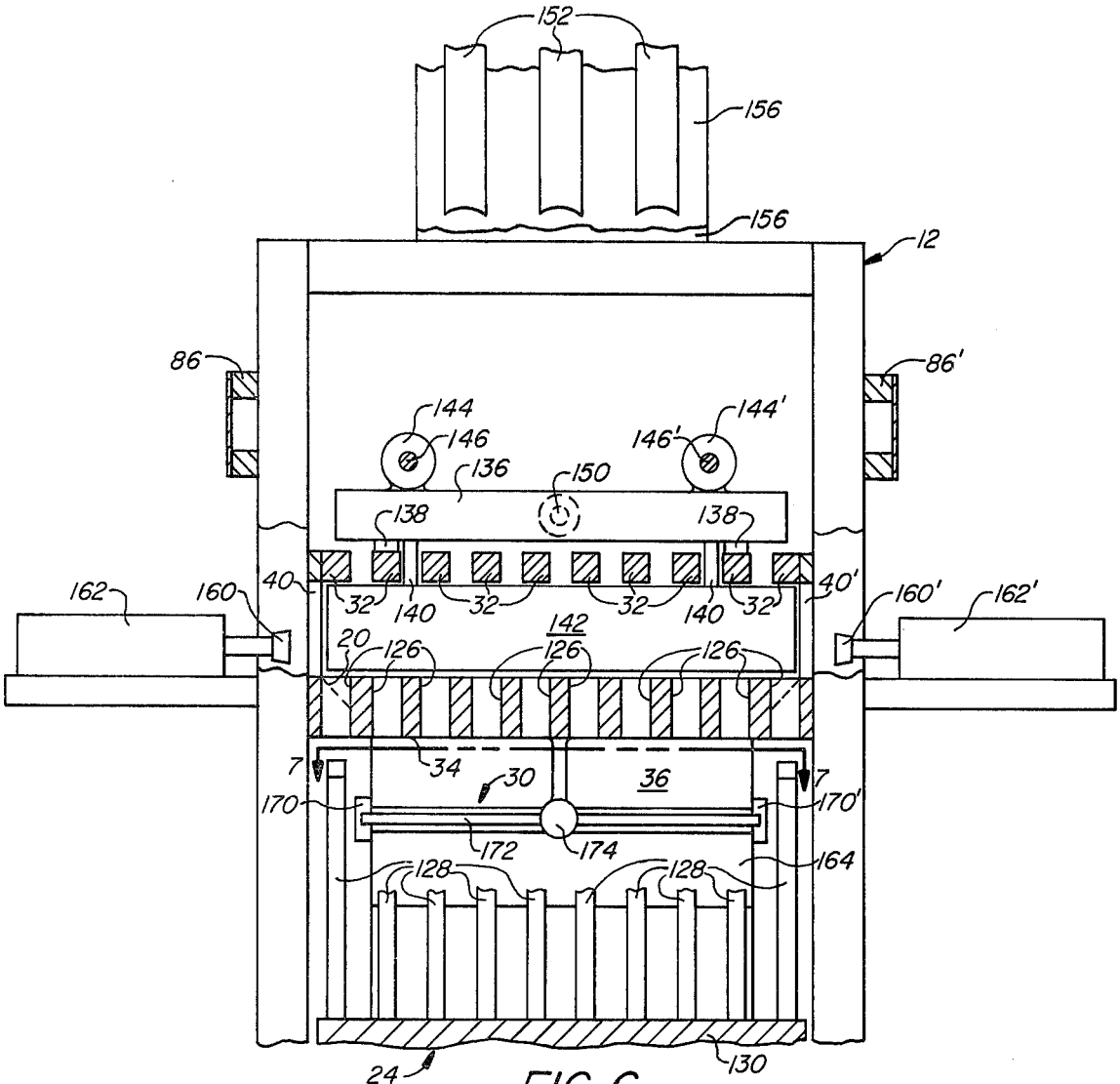
FIG. 6 is an enlarged fragmentary view taken approximately along the line 6—6 of FIG. 1, and showing some components of the apparatus in elevation and others in vertical section.

Each entraining member 108 is pivotally movable about the axis of its supporting pivot shaft 104, in unison with such shaft and the other members 108 thereon, between extended and retracted positions respectively shown in solid and phantom lines in FIG. 5. In the extended position of each entraining member 108, its lower tooth-like portion 114 projects angularly forwardly and downwardly into passageway 14 and the narrow leading end of such portion 114 is disposed in closely-spaced overlying relationship to the horizontal plane of passageway bottom plate 34 (FIGS. 1 and 6). When an entraining member 108 occupies its aforesaid extended position, further clockwise (as viewed in FIG. 5) pivotal movement thereof about the axis of its supporting shaft 104 is prohibited by then-occurring abutting engagement of its stop members 116 with those upper surfaces of carriage base plate 78 immediately adjacent the slot 102 through which such entraining member 108 extends. In the retracted (FIG. 5 phantom-line) position of each entraining member 108, no portion of it projects into passageway 14. At such time the upper surface of hook-like portion 114 of each member 108 abuts the undersurface of carriage base plate 78, and the lower surface of hook-like portion 114 is disposed at the elevation of the plane of the undersurface of the spaced grid bars 32 defining the upper extremity of passageway 14.

In addition to the previously-discussed shafts 104, eight shafts 118 are provided in association with respective ones of the eight rows of entraining members 108. Each shaft 118 extends freely through bores within the shank-like upper portions 112 of the members 108 of a corresponding one of the rows, and also extends freely through bores within two innerconnecting members 120 which extend longitudinally of carriage 76 between the rearmost and forwardmost ones of shafts 118. As is shown in FIG. 4, the rear ends of members 120 are pivotally connected to the rod component 122 of a fluid-operated piston and cylinder assembly 124 mounted upon carriage 76. Pressurized fluid is supplied to the forward end of the cylinder component of assembly 124 during commencement of each stroke of rearward movement of carriage 76: Rearward movement of carriage 76 tends to cause portions 114 of members 108 to become disengaged from, and to ride upwardly upon, strand material within passageway 14. During rearward movement of carriage 76, and as a result both of such movement and of the pressurized fluid then present within the forward end portion of the cylinder component of assembly 124, members 108 therefore assume their retracted (phantom-line) positions of FIG. 5. When pressurized fluid is introduced into the rearward end of assembly 124, as occurs at preselected times during forward-movement strokes of carriage 76, assembly 124 and the effect of gravity of course then bias members 108 toward their extended (solid-line) positions of FIGS. 1 and 5.

The section of passageway bottom plate 34 intermediate compartment 16 and outlet 20 is provided with a plurality of spaced openings 126 (FIGS. 1,6 and 9) therethrough. Illustratively there are three longitudinally-spaced rows of such openings 126, each row extending across substantially the full width dimension of passageway base plate 34 and being comprised of ten of the openings 126. All of the openings 126 are in vertical alignment with overlying ones of the spaced grid bars 32 defining the upper extremity of passageway 14. Strand restraining means 24 of apparatus 10 (FIGS. 1 and 6) comprises three rows of vertically-extending, spike-like members 128, the longitudinal axes of which are in a vertical alignment with respective ones of the openings 126 within passageway bottom plate 34. Spike members 128 are rigidly supported at their lower ends by a base member 130, which in turn is supported upon the vertically-extending rod component 132 of a fluid-operated piston and cylinder assembly 134. The array of spike members 128 normally occupies a retrated position, such as shown in FIGS. 1 and 6, wherein the free upper ends of members 128 underlie passageway plate 34 and do not project into passageway 14. The introduction of pressurized fluid into the lower end of the cylinder component of assembly 134 causes spike members 128 to be moved upwardly to an extended position (indicated by phantom lines in FIG. 1) wherein they project into passageway 14 through respective ones of the openings 126 within passageway bottom plate 34. When in their extended position, the upper ends of members 128 are disposed in closely-spaced relationship to overlying ones of the grid bars 32 defining the upper extremity of passageway 14, and the side surfaces of members 128 are disposed closely adjacent the vertical planes containing the opposite side surfaces of overlying ones of the grid bars 32. When pressurized fluid is introduced into the upper end of the cylinder component of assembly 134, base member 130 and spike members 128 of course return to the retracted positions illustrated in solid lines in FIGS. 1 and 6. As is indicated in FIG. 1, the rearward face of base member 130 abuts and is movable vertically along an adjacent upright portion of frame 12 of apparatus 10. The rearwardly-directed forces imposed upon restraining means 24, during use thereof, are prevented by the aforesaid abutment from being transmitted to assembly 134.

Figure 8:
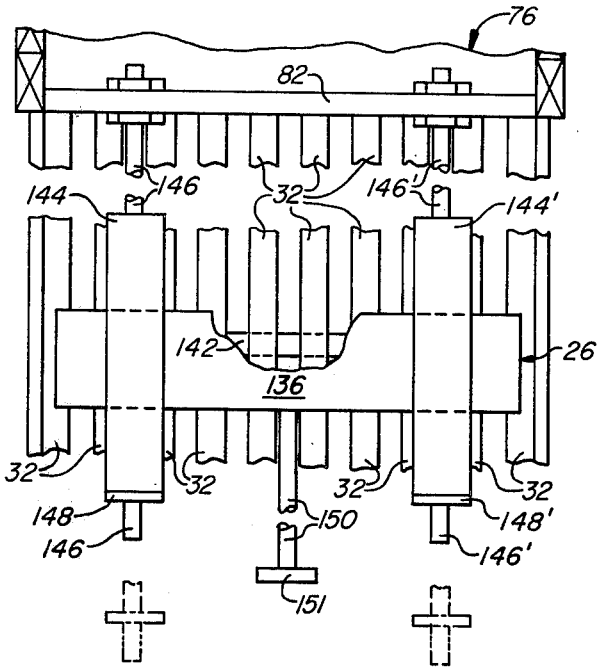
FIG. 8 is an enlarged, fragmentary, foreshortened top-plan view of the pusher means and some associated components of the apparatus, the pusher means also being shown in FIGS. 1 and 6.
Figure 9:
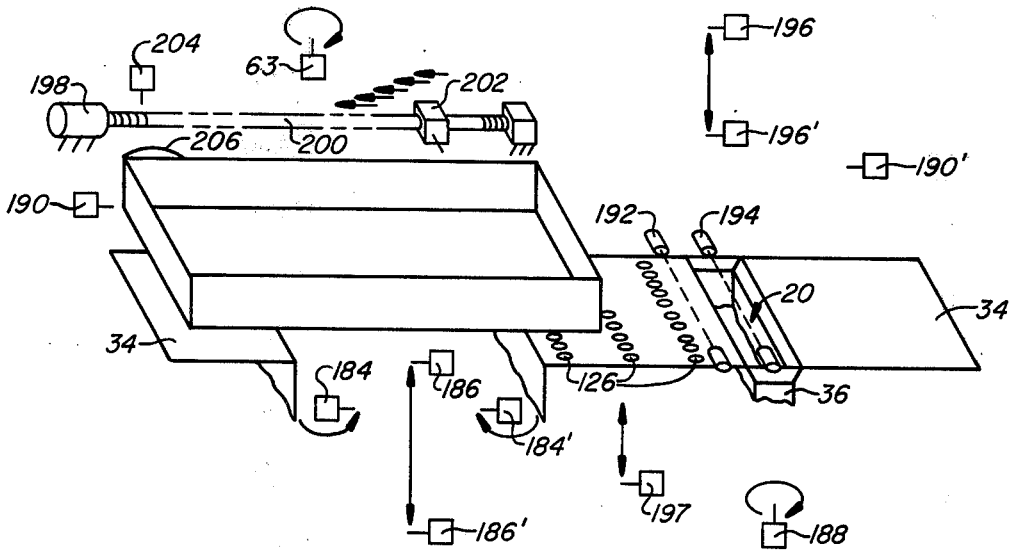
FIG. 9 is a schematic representation of some of the control components of the apparatus.

Referring now primarily to FIGS. 1,6 and 8, pusher means 26 of apparatus 10 includes a base member 136 which is supported upon the forward (rightward, as viewed in FIG. 1) expanse of grid bars 32, as by suitable bearings 138 (FIG. 6), for movement longitudinally thereof between rearwardmost and forwardmost positions respectively indicated by solid and phantom lines in FIG. 1. Support arms 140 (FIG. 6) depending downwardly from base member 136 through the spaces between adjacent ones of grid bars 32 support a blade or rake-like member 142, which is disposed within passageway 14, for movement in unison with base member 136. Blade 142 spans substantially the entire width and heigth of the interior of passageway 14. A pair of tubular abutment members 144,144' are fixedly mounted in any suitable manner upon the upper surface of base member 136. Elongate shafts 146,146' extend freely through respective ones of members 144,144', and at their rearmost ends are fixedly secured to front wall 82 of carriage member 76 (FIGS. 1 and 8) for movement with such carriage member longitudinally of apparatus 10. Collars 148,148' (FIG. 8) upon the forward end portions of the respective shafts 146,146' have an enlarged diameter which prevents their passage through tubular members 144,144'. As carriage member 76 moves forwardly from its solid-line and toward its phantom-line position shown in FIG. 1, pusher means 26 remains stationary in its rearmost (FIG. 1 solid-line) position until such time as carriage 76 abuts the rear ends of tubular abutment members 144,144'. Prior to such abutment, the forward movement of carriage 76 merely advances shafts 146,146' longitudinally through the bores of members 144,144'. Following and in response to the aforesaid abutment, pusher means 26 is moved forwardly by and in unison with carriage 76 until such components reach their forwardmost positions indicated by phantom lines in FIG. 1. Shafts 146,146' then project through and outwardly from the forwardmost end of apparatus 10. During the initial phase of thereafter-ensuing rearward movement of carriage 76 back toward its solid-line position of FIG. 1, pusher means 26 remains stationary since at such time shafts 146,146' slide freely through tubular members 144,144'. However, when the collars 148,148' (FIG. 8) upon the forward end portions of shafts 146,146' abut the forward ends of members 144,144', such abutment then causes pusher means 26 to move rearwardly in unison with carriage 76 until such members reach their rearmost positions indicated in solid lines in FIG. 1. During the aforesaid movement of pusher means 26 its blade member 142 engages any strand material previously withdrawn by entraining means 22 and present within that portion of passageway 14 projecting forwardly of outlet 20, and moves such strand material rearwardly through the passageway back to outlet 20. Blade member 142 overlies the forward edge portion of outlet 20 when pusher means 26 occupies its rearmost position. A shaft 150 (FIGS. 1 and 8) is fixedly connected at its rearward end to base member 136 of pusher means 26, for movement in unison therewith. Shaft 150 extends freely through a tubular abutment member (not shown in the drawings) fixedly mounted upon the forwardmost (rightmost, as viewed in FIG. 1) end portion of frame 12 of apparatus 10, and at its free end mounts a collar 151 which abuts the aforesaid abutment member when pusher means 26 reaches its rearmost position. This prohibits pusher means 26 from overtraveling its rearmost position, as might otherwise result if a binding condition should occur between either of the shafts 146,146' and the tubular member 144,144' through which it extends during that portion of the rearward movement of carriage 76 which precedes abutment of collars 148,148' with members 144,144'. Additionally, the shaft 150 assists in stabilizing both the forward and rearward movement of pusher means 26.

Referring now particularly to FIGS. 1 and 6, stuffer means 28 of apparatus 10 includes a plurality (illustratively three) of elongate, vertically-extending stuffer members 152. Members 152 are preferably formed from rigid steel bars, the lower ends of which have a smooth concave configuration. Members 152 are vertically movable between extended and retracted positions by a fluid-operated piston and cylinder assembly 154 (FIG. 1) which is fixedly mounted atop frame 12 of apparatus 10 by a frame extension 156. A slide-block 158, which is mounted within frame extension 156 and whose vertical movement is guided thereby, innerconnects the lower end of the rod component of assembly 154 and the upper ends of members 152. When occupying their illustrated retracted positions (FIGS. 1 and 6), as they normally do due to the presence of pressurized fluids within the lower portion of the cylinder component of assembly 154, members 152 are disposed directly above that portion of passageway 14 containing outlet 20 of apparatus 10. The introduction of pressurized fluid into the upper end portion of the cylinder component of assembly 154 causes members 152 to be moved rapidly downwardly to their extended positions, wherein they project through the vertical dimension of passageway 14 and through the approximate center (in the longitudinal direction of apparatus 10) of outlet 20, and into the duct 36 communicating with such outlet. To permit free passage of members 152 through the array of grid bars 32 defining the upper extremity of passageway 14, those bars 32 immediately adjacent the path of vertical travel of bars 152 have lengthwise sections (not shown in the drawings) of reduced widths. During movement thereof from their retracted and to their extended positions, members 152 engage any strand material then disposed within passageway 14 and within the path of travel of such members, and force such material downwardly through outlet 20 and into duct 36. It has been found that realization of this desired result is facilitated if, during each usage thereof, members 152 are rapidly reciprocated a plurality of times (e.g., three times) between their extended and retracted positions.

To further improve the effectiveness of its aforesaid operation, stuffer means 28 preferably and illustratively also includes a pair of auxiliary stuffer members 160,160' (FIG. 6) which are horizontally movable in unison with one another between extended and retracted positions by fluid-operated piston and cylinder assemblies 162,162' respectively mounted upon opposite sides of apparatus 10 adjacent the openings 40,40' provided within frame panels 38,38'. Members 160,160' are respectively mounted upon the rod components of assemblies 162,162', and in their illustrated retracted positions are disposed exteriorally of passageway 14. Assemblies 162,162' operate in unison with the previously-discussed assembly 154 which controls the movement of vertical stuffer members 152. Therefore, when pressurized fluid is introduced into the upper end of assembly 154, it is also simultaneously introduced into the outer ends of assemblies 162,162', causing movement of auxiliary stuffer members 160,160' through frame openings 40,40' and into passageway 14. During such movement of members 160,160', any strand material within the paths of travel thereof is displaced a sufficient distance toward the longitudinal center of apparatus 10 as to be within the paths of vertical travel of the laterally-outermost ones of the vertical stuffer members 152. The length of the strokes of members 160,160' is sufficiently small that neither of such members, when in its fully extended position, extends into the path of travel of any of the vertical stuffer members 152. The relatively short strokes of movement of members 160,160' also insures that, during each usage of stuffer means 28, members 160,160' will reach their fully-extended positions while vertical members 152 are still descending to the elevation of members 160,160', notwithstanding the fact that assemblies 154 and 162,162' are actuated substantially simultaneously.

Figure 7:
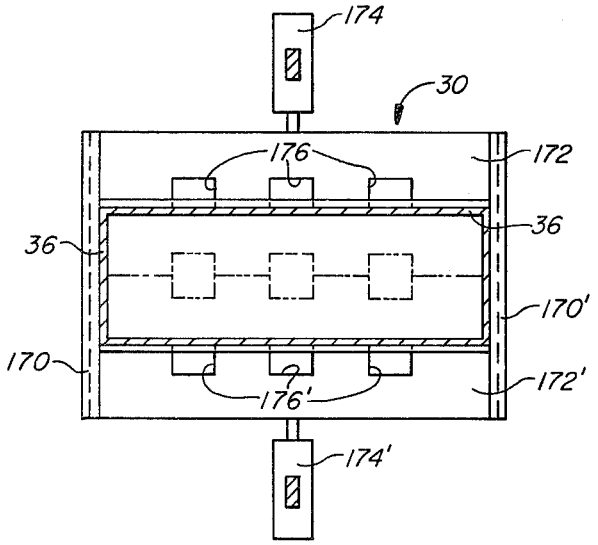
FIG. 7 is a view taken substantially along the lines 7—7 of FIG. 6, showing some components of the apparatus in top plan and others in horizontal section.

The duct 36 (FIGS. 1,6,7 and 9) underlying passageway outlet 20 may extend to any of various types of known apparatuses suitable for the further processing in a desired manner of the strand material discharged through outlet 20. Illustratively and preferably however, duct 36 communicates via a connecting duct 164 (see particularly FIGS. 1 and 6) with the inlet of a rotary cutting device 166 which is powered by suitable drive means including a drive motor 168. Device 166 simultaneously reduces the length of the strand material received therein and "opens" such strand material, thereby converting the same to a fibrous product which is admirably suited, following its discharge through an outlet duct 170 (FIG. 1) and its possible further processing, for various end uses. It is desirable, from the viewpoint of achieving maximum production, that device 166 receive strand material through ducts 36,164 on a substantially continuous basis during its operation. On the other hand, overloading of device 166 might well damage such device and/or impair the quality of its fibrous output. Apart from other possible causes, overloading of device 166 could at times result from excessive quantities of strand material being pulled into the device by a "self-feeding" action. However overloading of device 166 might be caused, gate means 30 of apparatus 10 minimizes the possibility of ensuring detrimental consequences, by impeding the passage of strand material through ducts 36,164 to device 166 when the device is overloaded. As shown in FIGS. 1,6 and 7, the adjacent ends of ducts 36,164 are spaced vertically from each other and are innerconnected adjacent their opposite side by horizontally extending channel-like members 170,170', respectively. Gate means 30 includes plate-like gate members 172,172' which extend between channel members 170,170' and are mounted thereby for horizontal reciprocatory movement toward and away from each other between retracted and extended positions respectively indicated by solid and phantom lines in FIG. 7. The aforesaid movement is simultaneously imparted to members 172,172' by fluid-operated piston and cylinder assemblies 174,174'. The cylinder components of assemblies 174,174' are fixedly connected to frame 12 of apparatus 10, and the outer ends of the respective rod components of the assemblies are respectively connected to associated ones of the gate members 172,172'. When occupying their retracted (solid-line) positions, members 172,172' do not project into ducts 36,164 and their confronting edges are disposed between suitable horizontally-extending flanges provided upon the confronting ends of such ducts. The introduction of pressurized fluid into the outer end portions of the cylinder components of assemblies 174,174' moves members 172,172' from their retracted positions to their extended positions shown in phantom lines in FIG. 7, wherein members 172,172' abut one another and block the passage of material from duct 36 to duct 164. The provision of generally U-shaped openings 176,176' within the confronting edge portion of members 172,172', as is also shown in FIG. 7, permits rapid movement of members 172,172' to their extended positions when required, even if at such time vertical stuffer members 152 (FIGS. 1 and 6) should occupy their downwardly-extended positions.

Figure 10:
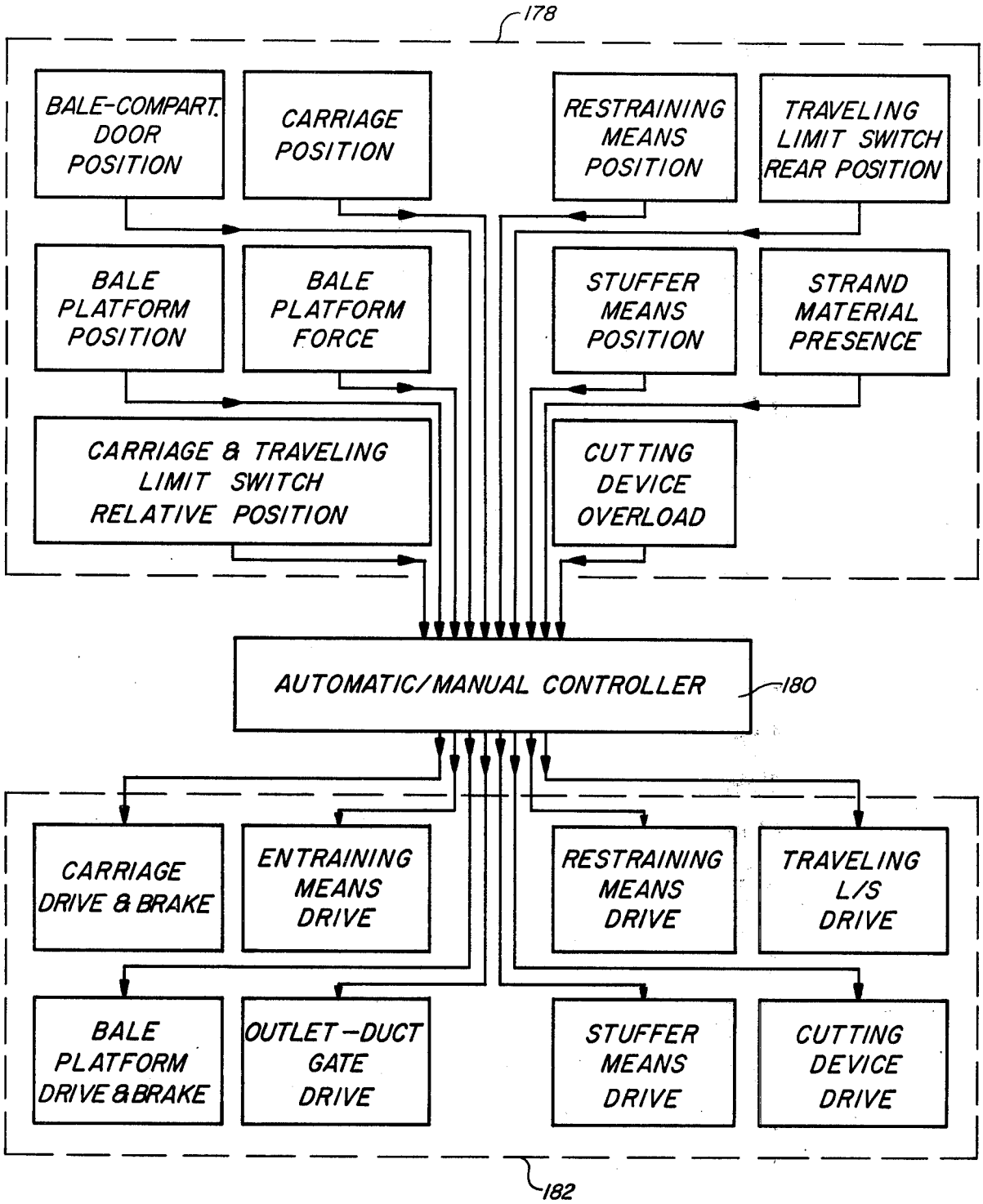
FIG. 10 is a block diagram of the control means of the apparatus.

Apparatus 10 further includes suitable electrical control means, shown in block-diagram form in its entirety in FIG. 10, for causing the previously-described components of the apparatus to perform their respective functions at desired times in proper sequence and in non-interfering relationship to each other. As indicated by block 178 of FIG. 10 the control means includes a plurality of detector devices which detect the positions or other conditions of various components of apparatus 10. Data from the detector components is transmitted to an automatic/manual controller 180 incorporating suitable logic circuitry or the like, which correlates such data and in turn transmits control signals to the drive units of the various driven components of apparatus 10, indicated in block 182 of FIG. 10. During operation of apparatus 10 controller 180 would normally perform its signal-transmitting functions, at proper times and in proper correlated sequence, in automatic fashion. While controller 180 is also adapted for alternative manual operation, such would not be used during normal operation of apparatus 10 and, even when employed, would not be effective to transmit to the drive components (block 182 of FIG. 10) of apparatus 10 any operating signals whose transmission would be detrimental to the apparatus or the operation thereof.

Illustrative embodiments of the detector devices indicated by block 178 of FIG. 10 are schematically shown, along with certain additional components of apparatus 10, in FIG. 9 of the drawings. As is indicated in FIG. 9, the open and closed positions of doors 42 (FIG. 1) of bale compartment 16 is detected by limit switch 184,184' suitably mounted in association with such doors: For safety reasons, controller 180 (FIG. 10) will not permit operation of apparatus 10 except while both doors 42 are closed. Limit switches 186,186' respectively detect the extreme upward and downward positions of the platform 58 (FIGS. 1 and 3) within compartment 16: Controller 180 (FIG. 10) will not permit movement of platform 58 beyond the aforesaid extreme positions thereof, and will automatically stop operation of apparatus 10 when switch 186 is actuated. Switch 63 is the previously-discussed one forming part of the unit 62 (FIG. 2) associated with platform drive unit 61 (FIG. 2): Controller 180 (FIG. 10) halts upward movement of platform 18 when switch 63 signals that the compressive force upon the strand mass 18 supported by the platform is of the desired magnitude. Switch 188 is a torque-responsive one, operatively associated with the motor 168 (FIG. 1) which drives cutting device 166, for performing the previously-described function of detecting an overload condition within cutting device 166:

Controller 180 (FIG. 10) actuates gate means 30 (FIGS. 1,6 and 7) and halts the operation of entraining means 22 (FIG. 1) and stuffer means 28 (FIGS. 1 and 6) when and while switch 188 signals that cutting device 166 is overloaded. Limit switches 190,190' respectively detect the arrival of carriage 76 (FIG. 1) at its forwardmost and rearwardmost positions: In response to the actuation of switch 190 controller 180 (FIG. 10) causes reversal of the theretofore rearward direction of movement of carriage 76, and also causes retraction of strand restraining means 24 (FIGS. 1 and 6). In response to the actuation of switch 190', controller 180 (FIG. 10) causes reversal of the theretofore forward movement of carriage 76, and causes movement of restraining means 24 to its extended position, and causes the introduction of pressurized fluid into the forward end of the assembly 124 associated with strand entraining members 108 (FIGS. 1,5 and 6). Members 108 therefore return to their retracted positions (FIG. 5, phantomlines) during rearward movement of carriage 76, as a result both of such rearward carriage movement and the action of assembly 124. In addition to the switches 190,190', the carriage-position detecting means indicated in block 178 of FIG. 10 also includes a photoelectric lamp-receiver unit designated by the numeral 192 in FIG. 9. Unit 192 detects whether carriage 76 occupies a position obstructing the path of travel of stuffer means 28 (FIGS. 1 and 6): Controller 180 (FIG. 10) prohibits actuation of stuffer means 28 until carriage 76 occupies a non-obstructing rearward position relative thereto. The other photoelectric unit 194 shown in FIG. 9 detects the presence of "bridging" or other accumulated strand material in that portion of passageway 14 immediately above outlet 20: Controller 180 (FIG. 10) actuates stuffer means 28 (FIGS. 1 and 6) when the presence of such strand material is detected by unit 192 and when unit 190 indicates that carriage 76 is in a non-obstructive position relative to the stuffer means. During each period of actuation of stuffer means 28, controller 180 (FIG. 10) preferably causes the stuffer members 152,160,160' to undergo a plurality (e.g., three) of reciprocatory strokes between their retracted and extended positions. If the presence of strand material is then still detected by unit 192, controller 180 will initiate another similar cycle of operation of stuffer means 28, and so on until unit 192 detects no longer detects the presence of strand material within its field of vision (or until, as previously noted, overloading of cutting device 166 is detected by switch 188). Also during each period of actuation of stuffer means 28, controller 180 causes movement of carriage 76 to be halted, so that no additional strand material will then be transported to outlet 20 by either strand entraining members 108 (FIGS. 1,4 and 5) or pusher means 26 (FIGS. 1,6 and 8). Limit switches 196,196' of FIG. 9 respectively detect the retracted and extended positions of stuffer means 28: The signals transmitted by such switches to controller 180 (FIG. 10) are there correlated to determine whether blockage of the field of vision of photoelectric unit 194 is caused by strand material or by the vertical stuffer members 152 (FIGS. 1 and 6), and also is employed when the controller causes the stuffer members to undergo, as previously described, a plurality of reciprocatory strokes between their extended and retracted positions. Further, and as a safety feature backing-up the operation of photoelectric unit 192, controller 180 will not permit carriage 76 to be driven forwardly except when switch 194 indicates that stuffer means 28 is fully retracted. A similar back-up safety function is performed by the limit switch 197 of FIG. 9, which switch verifies full retraction of strand restraining means 24 (FIGS. 1 and 6): Controller 180 (FIG. 10) prohibits carriage 76 from being driven forwardly except when switch 198 indicates that restraining means 24 is fully retracted.

Among the other drive members indicated in block 182 of FIG. 10 is a "traveling limit switch drive." As is shown in FIG. 9, this consists of a reversible motor 198 driveably connected to the rearward end of an elongate threaded shaft 200 mounted for rotation about its axis in spaced parallel reationship to the rearward portion of the path of travel of the carriage 76. A limit switch 202, designated as a "traveling" limit switch in block 178 of FIG. 10, is mounted upon threaded shaft 200 for movement forwardly or rearwardly therealong in response to rotation of the shaft by motor 198 in a "forward" or "rearward" rotative direction respectively. Controller 180 (FIG. 10) causes motor 198 to move switch 202 rearwardly a preselected distance each time carriage 76 reaches its forwardmost position and actuates limit switch 190. The magnitude of the rearward strokes of movement of switch 202, which movement-strokes are indicated by the arrows adjacent switch 202 in FIG. 9, is preselected by adjustment of a suitable timer or similar component (not shown) of controller 180. A limit switch 204 (FIG. 9, and also indicated in block 178 of FIG. 10) detects arrival of the traveling limit switch 202 at its rearmost position along shaft 200. In response to actuation of switch 204, controller 180 (FIG. 10) causes motor 198 to return traveling limit switch forwardly a preselected and adjustably variable distance along shaft 200, and also causes bale platform drive unit 61 to move bale platform 58 upwardly until compressive-force detecting switch 63 is again actuated. Controller 180 (FIG. 10) insures that the foregoing sequence of events always occurs during one of the time periods between successive forward-movement strokes of carriage 76: The entraining members 108 (FIGS. 1,4 and 5) carried by carriage 76 then occupy, as previously described, their retracted positions. Controller 180 causes movement of entraining members 108 to their extended positions in response to the actuation, during forward (only) movement of carriage 76, of traveling limit switch 202 by an actuator 206 (FIG. 9) upon carriage 76. The point along any one of the forward-movement strokes of carriage 76 at which entraining members move to their extended positions therefore is dependent upon the particular longitudinal position then occupied by traveling limit switch 202 along shaft 200. This in turn is dependent upon the preselected distances which controller 180 (FIG. 10) causes motor 198 to move switch 202 during each of the latter's strokes of forward and rearward movement.

In one extreme mode of operation, controller 180 might be preadjusted so as to cause limit switch 202 to move only a slight distance away from switch 204 during each of its forward-movement strokes, and to return to actuating engagement with switch 204 during the first one of its thereafter-ensuing rearward-movement strokes. Such mode of operation would result in strand entraining members 108 being extended substantially simultaneously with the commencement of each forward stroke of movement of carriage 76, and would also result in upward movement of bale platform 58 after each forward-movement stroke of carriage 76. This mode of operation would produce very rapid withdrawal of large quantities of the strand material 18 from compartment 16 (FIG. 1), but with most types of strand material could probably not be satisfactorily empolyed as it would likely cause overloading or "choking" of that portion of passageway 14 (FIG. 1) forwardly of compartment 16. In another extreme mode of operation of apparatus 10, controller 180 (FIG. 10) might be pre-adjusted to cause limit switch 202 (FIG. 9) to be moved a maximum distance from switch 202 during each of its forward-movement strokes, to a position such as is illustrated in FIG. 9; and to cause each rearward-movement stroke of switch 202 to be only a small fractional part of such distance. In accordance with this mode of operation strand entraining members 108 would be extended at a relatively late point in time during the first of the forward-movement strokes of carriage 76, and would thereafter be extended at slightly and progressively earlier points in time during each of the subsequently ensuing forward-movement strokes of carriage 76. Upward movement of platform 58 (caused as previously described by controller 180 upon actuation of switch 204 by traveling limit switch 202) would occur only after completion of a large number (e.g., one hundred) of forward-rearward movement strokes of carriage 76 and rearward-movement strokes of switch 202. This mode of operation would therefore produce a more gradual and progressive withdrawal and advancement of the strand material from the mass 18 thereof within compartment 16, and is therefore unlikely to produce any undesireable "choking" or overloading of passageway 14. By appropriate preselection of the distances through which controller 180 (FIG. 10) causes switch 202 to travel during its forward and/or rearward strokes, the rate of withdrawal of strand material from any particular mass 18 thereof within compartment 16 may be so adjusted as to achieve an optimum rate at which apparatus 10 performs with a high degree of efficiency without "choking" or overloading of that portion of passageway 14 forwardly of compartment 16.

Irrespective of the foregoing adjustive mode of operation of apparatus 10, controller 180 (FIG. 10) of course still functions as previously described to temporarily halt movement of carriage 76 and actuate stuffer means 28 whenever such carriage is in a non-interfering position and an accumulation of strand material is present within that portion of passageway 14 above outlet 20; and to temporarily halt operation of all of the foregoing components and actuate gate means 30 (FIGS. 1,6 and 7) if cutting device 166 should become overloaded.

It will be appreciated in the latter connection that the strand material discharged through outlet 20 of apparatus 10 could be received by some suitable structure or device other than or in addition to the cutting device 166 specifically shown. For example, the material discharged from outlet 20 and/or from device 166 might be received by a suitable hopper having associated therewith a level-responsive switch or the like effective, in a manner similar to that of the load-responsive switch 188 associated with device 166, to regulate the operation of apparatus 10.

While a preferred embodiment of the invention has been specifically shown and described, it is to be understood that this was for purposes of illustration only, and not for purposes of limitation, the scope of the invention being in accordance with the following claims.

That which is claimed is:

1. Apparatus for disintegrating a bale-like mass of textile strand material, said material including synthetic textile strands of large-magnitude tensile strength, comprising:

a receiving station adapted to receive the bale-like mass of strand material to be disintegrated;

outlet means spaced forwardly of said receiving station for reception of strand material withdrawn from the bale-like mass at said receiving station;

means defining an elongate passageway extending between said receiving station and said outlet means;

strand entraining means reciprocatorily movable forwardly and rearwardly along a path of travel adjacent and generally parallel to said elongate passageway for, during forward movement thereof, withdrawing strand material from the bale-like mass at said receiving station and transporting withdrawn strand material through said passageway to and to locations adjacent said outlet means;

and extendable and retractable strand restraining means, movable between a retracted position exteriorally of said passageway to an extended position wherein said restraining means projects into said passageway, for restraining rearward movement of withdrawn strand material back to said receiving station under the impetus of rearward movement of said entraining means.

2. Apparatus as in claim 1, wherein said passageway and said path of travel of said entraining means project forwardly beyond said outlet means; and further including pusher means, disposed within and movable longitudinally of said forwardly-projecting portion of said passageway, for moving withdrawn strand material rearwardly through said projecting passageway portion back to said outlet means.

3. Apparatus as in claim 1, and further including stuffer means movable between a retracted position exteriorally of said passageway and an extended position within said passageway and adjacent said outlet means for, when extended, assisting introduction into said outlet means of withdrawn strand material adjacent thereto.

4. Apparatus as in claim 1, wherein said entraining means includes a plurality of hook-like members movable between retracted positions outside of passageway and extended positions in which said members project within said passageway, said members being extended during forward movement of said entraining means along said path of travel and being retracted during rearward movement of said entraining means along said path of travel.

5. Apparatus as in claim 1, and further including a strand processing device; duct means innerconnecting said outlet means and said processing device for during normal operation of said apparatus conducting strand material introduced into said outlet means to said processing device; and gate means associated with said duct means and movable between retracted and extended positions, wherein said gate means is respectively disposed exteriorally and interiorally of said duct means, for impeding passage of strand material to said processing device upon overloading of said device.

6. Apparatus as in claim 1, wherein said receiving station includes a compartment having an open top portion through which said passageway extends; a vertically-movable platform within said compartment, said platform being adapted to support the bale-like mass of strand material to be disintegrated; platform drive means for periodically imparting strokes of upward movement to said platform and to the strand material thereon during normal operation of said apparatus; and means for halting each of said strokes of upward movement of said platform in response to the imposition of a compressive force of predetermined magnitude upon the upper surface of the mass of strand material supported by said platform.

7. Apparatus for disintegrating a bale-like mass of textile strand material, said material including synthetic textile strands of large-magnitude tensile strength, comprising:

a receiving station adapted to receive the bale-like mass of strand material to be disintegrated;

outlet means spaced from and located forwardly of said receiving station for reception of strand material withdrawn from the bale-like mass thereof at said receiving station;

an elongate passageway extending between said receiving station and said outlet means and projecting forwardly from said outlet means;

strand entraining means reciprocatorily movable forwardly and rearwardly along a path of travel adjacent and generally parallel to said elongate passageway for, during forward movement thereof, withdrawing strand material from the bale-like mass thereof at said receiving station and transporting withdrawn strand material through said passageway to said outlet means and to the portion of said passageway projecting forwardly beyond said outlet;

and pusher means operable during the time intervals between successive strokes of forward movement of said entraining means along said path of travel thereof, for then rearwardly-moving withdrawn strand material within said projecting passageway portion back to said outlet means.

8. Apparatus as in claim 7, and further including lost-motion innerconnecting means innerconnecting said entraining means and said pusher means for moving said pusher means rearwardly through said projecting passageway portion during and in response to rearward movement of said entraining means along said path of travel thereof.

9. Apparatus as in claim 8, and further including extendable and retractable strand restraining means movable between a retracted position outside of said passageway to an extended position within said passageway for restraining rearward movement of withdrawn strand material back to said receiving station under the impetus of rearward movement of said entraining means.

10. Apparatus as in claim 9, wherein said restraining means is, when occupying said extended position, disposed within a portion of said passageway intermediate said receiving station and said outlet means.

11. Apparatus as in claim 11, and further including stuffer means movable between a retracted position outside of said passageway to an extended position within said passageway and immediately adjacent said outlet means for, when actuated, assisting introduction into said outlet means of withdrawn strand material adjacent thereto.

12. Apparatus as in claim 11, and further including means for actuating said stuffer means, when said entraining means occupies a non-interfering position relative thereto, in response to the presence of an accumulation of withdrawn strand material within the portion of said passageway immediately adjacent said outlet means.

13. Apparatus as in claim 7, and further including a strand processing device; duct means innerconnecting said outlet means and said processing device for during normal operation of said apparatus conducting strand material introduced into said outlet means to said processing device; and gate means associated with said duct means and movable between retracted and extended positions, wherein said gate means is respectively disposed outside of and within said duct means, for impeding passage of strand material to said processing device upon overloading of said device.

14. Apparatus as in claim 7, wherein said entraining means includes a plurality of hook-like members movable between retracted positions outside of said passageway and extended positions wherein said members project within said passageway; means for causing said members to occupy said retracted positions thereof during rearward movement of said entraining means along said path of travel, and for causing movement of said members to said extended positions thereof at preselected and adjustably-variable times during the forward-movement strokes of said entraining means along said path of travel thereof.

15. Apparatus as in claim 7, wherein said receiving station includes a compartment having an open top portion through which said passageway extends; a vertically-movable platform within said chamber, said platform being adapted to support the bale-like mass of strand material to be disintegrated; platform drive means for periodically imparting strokes of upward movement to said platform and to the strand material thereon during normal operation of said apparatus; and means for halting each of said strokes of upward movement of said platform in response to the imposition of a compressive force of predetermined magnitude upon the upper surface of the mass of strand material supported by said platform.

16. Apparatus for disintegrating a bale-like mass of textile strand material, said material including synthetic textile strands of large-magnitude tensile strength, comprising:

a receiving station adapted to receive the bale-like mass of strand material to be disintegrated;

outlet means spaced forwardly of said receiving station for reception of strand material withdrawn from the bale-like mass at said receiving station;

means defining an elongate passageway extending between said receiving station and said outlet means;

strand entraining means reciprocatorily movable forwardly and rearwardly along a path of travel adjacent and generally parallel to said elongate passageway for, during forward movement thereof, withdrawing strand material from the bale-like mass at said receiving station and transporting withdrawn strand material through said passageway to and to locations adjacent said outlet means;

and stuffer means movable between a retracted position outside of said passageway and an extended position within said passageway and immediately adjacent said outlet for, when actuated, assisting introduction into said outlet of withdrawn strand material adjacent thereto.

17. Apparatus as in claim 16, and further including means for actuating said stuffer means, when said entraining means occupies a non-interferring position relative thereto, in response to the presence of an accumulation of strand material within the portion of said passageway immediately adjacent said outlet means.

18. Apparatus as in claim 17, wherein said passageway and said path of travel of said entraining means project forwardly beyond said outlet means; and further including pusher means, disposed within and movable longitudinally of said forwardly-projecting portion of said passageway, for moving withdrawn strand material rearwardly through said projecting passageway portion back to said outlet means.

19. Apparatus as in claim 17, wherein said entraining means includes a plurality of hook-like members movable between retracted positions outside of passageway and extended positions in which said members project within said passageway, said members being extended during forward movement of said entraining means along said path of travel and being retracted during rearward movement of said entraining means along said path of travel.

20. Apparatus as in claim 17, and further including a strand receiving device; duct means innerconnecting said outlet means and said receiving device for during normal operation of said apparatus conducting strand material introduced into said outlet means to said receiving device; and means for regulating the quantity of strand material conducted through said duct means to said receiving device in accordance with the quantity of strand material within said receiving device.

21. Apparatus for disintegrating a bale-like mass of textile strand material, said material including synthetic textile strands of large-magnitude tensile strength, comprising:

a receiving station adapted to receive the bale-like mass of strand material to be disintegrated;

outlet means spaced forwardly of said receiving station for reception of strand material withdrawn from the bale-like mass at said receiving station;

means defining an elongate passageway extending between said receiving station and said outlet means;

a carriage member reciprocatorily movable forwardly and rearwardly along a path of travel adjacent and generally parallel to said elongate passageway;

a plurality of strand entraining members carried by said carriage member for movement therewith and for movement relative to said carriage member between retracted and extended positions wherein said entraining members are respectively disposed outside of and within said passageway; said entraining members being effective, when in said extended positions thereof and during forward movement of said carriage member, to withdraw strand material from the bale-like mass thereof at said receiving station and to transport withdrawn strand material through said passageway to and to locations adjacent said outlet means;

and means for causing said entraining members to occupy said retracted positions thereof during rearward movement of said carriage member along said path of travel, and for causing movement of said entraining members to said extended positions thereof at preselected and adjustably-variable differing times during successive forward strokes of movement of said carriage means along said path of travel.

* * * * *